United States Patent [19]

Applegate et al.

[11] 4,329,071

[45] May 11, 1982

[54] CURRENT COLLECTOR FOR RESISTIVE RIBBON PRINTERS

[75] Inventors: Steven L. Applegate; Stanley Dyer, both of Lexington, Ky.

[73] Assignee: International Business Machines Corporation, Armonk, N.Y.

[21] Appl. No.: 164,658

[22] Filed: Jun. 30, 1980

[51] Int. Cl.[3] ..... B41J 3/04

[52] U.S. Cl. ..... 400/120; 101/1; 219/216; 346/76 PH; 427/121

[58] Field of Search ..... 101/1, DIG. 2, DIG. 13; 400/119, 120; 219/216; 346/76 R, 76 PH, 76 L; 427/121

[56] References Cited

U.S. PATENT DOCUMENTS

| | | | |
|---|---|---|---|
| 2,713,822 | 7/1955 | Newman | 101/DIG. 2 |
| 3,719,261 | 3/1973 | Heinzer et al. | 400/120 |
| 3,744,611 | 7/1973 | Montanari et al. | 400/120 |
| 3,855,448 | 12/1974 | Hanagata et al. | 346/76 PH X |
| 3,995,729 | 12/1976 | Anton et al. | 400/120 |
| 4,064,982 | 12/1977 | Anton et al. | 400/119 X |
| 4,195,937 | 4/1980 | Baran | 400/120 |

OTHER PUBLICATIONS

"Color Thermal-Transfer Printing", Edgar et al., IBM ® Technical Disclosure Bulletin, vol. 23, No. 7A, pp. 2633-2634, 12/1980.

"Thermal Biasing Technique for Electrothermic Printing", Wilbur, IBM ® Technical Disclosure Bulletin, vol. 23, No. 9, p. 4302, 2/1981.

*Primary Examiner*—Steven A. Bratlie
*Assistant Examiner*—Moshe I. Cohen
*Attorney, Agent, or Firm*—George E. Grosser

[57] ABSTRACT

For an electro-thermal printer of the kind that uses a ribbon having a central conducting layer that is covered on one surface by a resistive layer that receives electrical printing currents and on the other surface by a thermally transferrable ink layer, printing current is collected from the conducting layer by an electrically conducting contactor at the ink layer surface of the ribbon. Such contact through the ink layer occurs on the takeup side of a printhead where the integrity of the ink layer is not of concern and voids in the ink layer occur as a result of ink transfers for printing. To increase the quality of the electrical connection, projecting points or barbs may be included on said contactor to penetrate to the conducting layer through intact portions of ink layer.

9 Claims, 6 Drawing Figures

FIG. 4
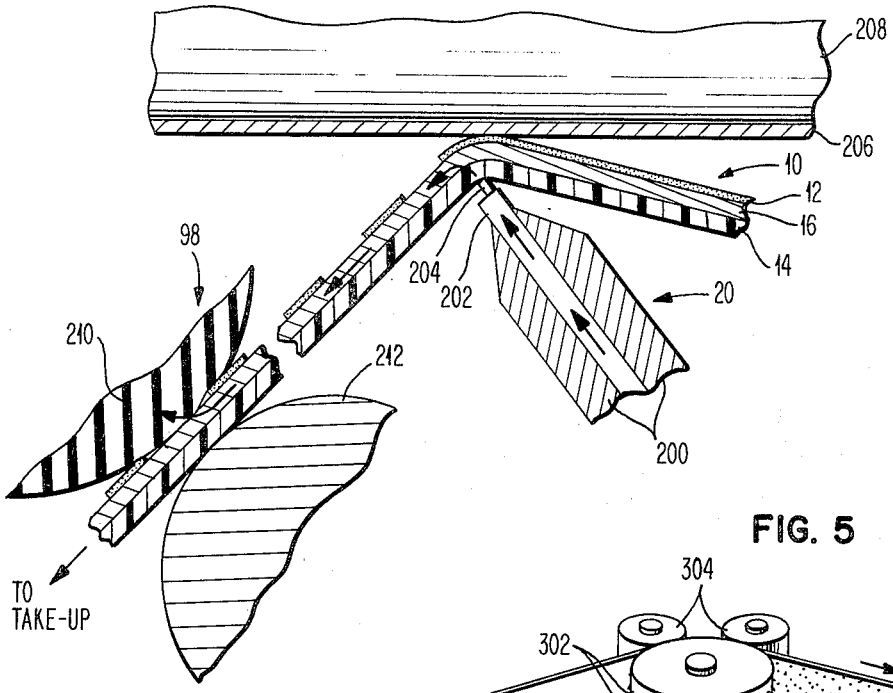
FIG. 5
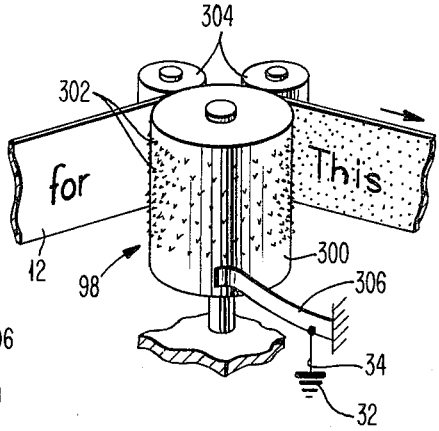
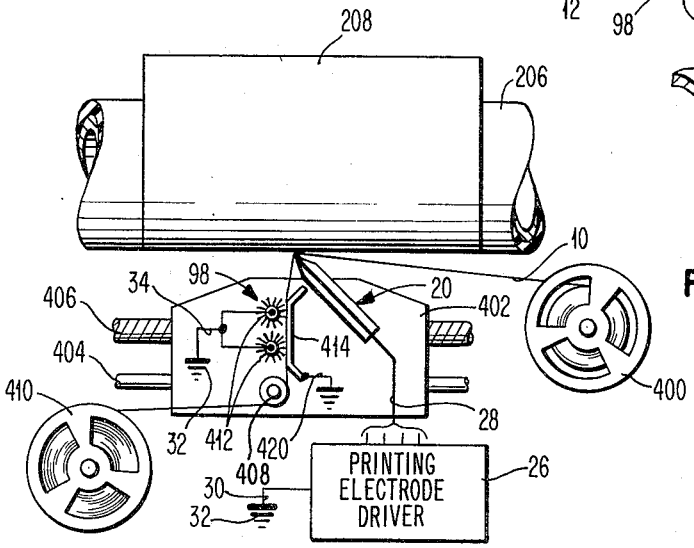
FIG. 6

CURRENT COLLECTOR FOR RESISTIVE RIBBON PRINTERS

DESCRIPTION

Field of the Invention

The present invention relates to printers that employ an ink ribbon that includes an outer electrically resistive layer to which electrical currents are selectively supplied to cause localized heating and ink transfer.

Background of the Invention

Various types of printers have been developed that produce marks on a receiving medium as a result of localized heating that is produced by electric currents: One type of electro-thermal printer relies on selective current applications to one or more printhead members that each include a resistive section which becomes heated and produces marks on heat sensitive paper.

Another type of electro-thermal printer uses similar resistive printhead members to locally heat a ribbon coated with thermally transferable ink to cause the transfer of ink to a receiving medium.

For a further type of electro-thermal printing, sometimes called electroerosion printing, a conducting layer is provided at an outer surface of the receiving medium and localized currents applied by printhead electrodes cause a vaporization of the conducting layer that leaves a visible mark.

Yet another type of electro-thermal printing employs a ribbon that has a thermally transferable ink on one outer surface and an electrically conducting layer on the other outer surface. Printing currents applied to the conducting layer cause localized conducting layer vaporization and resultant heating which results in ink transfer to mark a receiving medium.

The type of electro-thermal printing of main interest to the subject invention utilizes a ribbon having a central electrically conducting layer, one outer layer that is moderately conducting, with the other outer layer being composed of thermally transferrable ink. With such a ribbon, localized currents for causing ink transfer preferably do not vaporize or even melt layers other than the ink layer.

Sufficient heat to cause ink transfer is generated by current passing through the resistive layer to the conducting layer. One problem for such a printing arrangement is that of collecting the current supplied by printing electrodes to the ribbon.

U.S. Pat. No. 2,713,822 describes a marking arrangement that uses a pack of individual sheets for electrothermal printing. The pack covers the receiving medium and includes a sheet having thermally transferrable ink, an intermediate electrically conducting sheet and an electrically resistive sheet. In one implementation, the conducting sheet extends beyond the inked sheet to be accessable for current collection. For a second implementation, an alternating printing current is used to permit current collection using a capacitive effect between the conducting sheet and a conducting plate arranged adjacent the receiving medium. Both of these techniques for current collection present problems for implementation in a more conventional printer that employs a narrow ink ribbon. With an exposed edge, ribbon manufacture becomes more expensive and feeding and storage problems may be presented if the ribbon does not have uniform thickness across its width. And, if the conducting layer is exposed at the ribbon ends, the current path becomes quite long. As regards capacitive energy coupling, it would be difficult to provide sufficient energy for printing with a narrow ribbon configuration of this kind typically used for interactive printing.

U.S. Pat. No. 3,744,611 also describes a printer using a resistive ribbon for electro-thermal printing. A ground plate that surrounds the printing electrodes is provided for current collection. With such an arrangement, the printing current is collected from the resistive layer and the ground plate has a large enough area so that insufficient heat is produced by returning current to cause an unwanted ink transfer. With the arrangement as described, the most recently printed marks are covered by the ground plate electrode. Also, it may prove difficult to achieve adequate ground plate contact to avoid heating and attendant unwanted ink transfers while also sliding the printhead structure relative to the ribbon as printing progresses.

Brief Description of the Invention

The present invention involves a recognition that, for a resistive ribbon printer, after a section of ribbon has passed the printhead, the integrity of the ink layer is of little concern. Indeed, there are voids, where ink transfer has occurred, that expose the adjacent layer. For such a ribbon with an electrically conducting intermediate layer that collects printing current, an effective current return path can be established by engaging the conducting layer through the voids in the ink layer produced by printing.

To achieve good contact at the openings in the ink layer, a resilient contacting device is preferably used such as a metal brush or a roller formed of a conducting rubber. As an alternative, a contact surface may be used that includes rigid projecting edges or points that extend to contact the conducting layer. These projecting points may furthermore be adapted to pierce the ink layer which is typically thinner and more delicate than the resistive layer and is easily penetrated.

Irrespective of whether the ink layer is purposely penetrated, the contacting device is electrically conducting and is connected to the energy source to complete a path for printing current selectively supplied to the resistive layer by the printing electrodes.

Brief Description of the Drawings

A presently preferred implementation of the invention will now be described in detail with reference to the drawings wherein:

FIG. 4 is a cross-sectional view indicating current collection according to another alternative for the invention;

FIG. 5 is a perspective view of a further alternative for current collection according to the invention;

FIG. 6 is a plan view of an alternative for the invention in a printer environment.

Detailed Description of the Drawings

Figure 1:
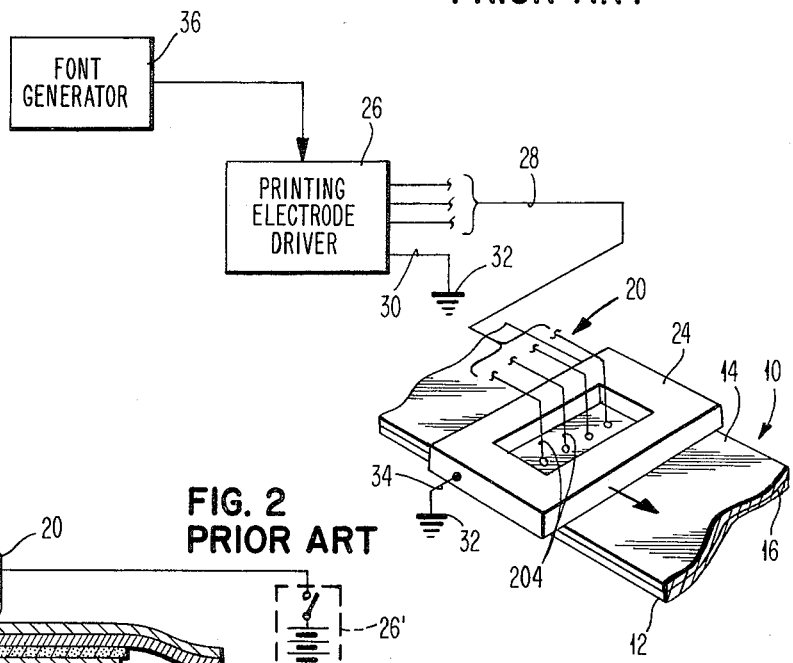
FIG. 1 PRIOR ART
FIG. 1 is a perspective view of a prior art current collector with associated electrical circuitry represented schematically.

Referring to FIG. 1, a ribbon 10 for electro-thermal printing includes an outer ink transfer layer 12, an outer layer 14 that has a moderate resistance (e.g. 200 to 1000 ohms/square) and an intermediate conducting layer 16. Such a ribbon 10 is known in the art, as was briefly mentioned above, and is known for use in cooperation with a printhead 20, comprising a set of electrodes 204, and an associated current collection plate 24 that surrounds the electrodes 204. In operation, the printhead 20 and current collection plate 24 are advanced over the ribbon 10 and a printing electrode driver 26 selectively energizes individual signal channels 28 that are connected to respective electrodes 204 of printhead 20. Current resultantly flows from printhead 20 into the moderately resistive layer 14 and causes localized heating in passing through to the conducting layer 16. The current travels in the conducting layer 16 and then through the moderately resistive layer 14 to current collection plate 24 which collects the current. The current path is completed over connection 34 to a common terminal 32 that is connected to a return current terminal 30 of the printing electrode driver 26.

Selective control of the energization of the signal channels by printing electrode driver 26 is in accordance with information signals supplied by a font generator 36 as is well known in the art of printing using electrically driven matrix printheads. It should be noted that a direction of current flow is assumed for convenience of explanation. The actual current flow may, however, be in either direction so long as a closed path is established having at one end the printing signal output channels 28 and at the other the collection terminal 30.

Figure 2:
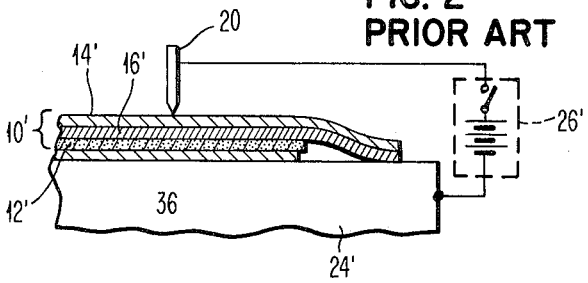
FIG. 2 PRIOR ART
FIG. 2 is a cross-sectional view of another prior art current collection arrangement.

Now referring to FIG. 2, a second prior art printing arrangement utilizes a pack 10' of printing sheets including an inktransfer sheet 12', a moderately resistive sheet 14' and a conducting sheet 16'. The conducting sheet 16' extends beyond the ink transfer sheet 12' to be exposed for engagement with a current collection plate 24'.

In operation, a printing electrode driver 26' energizes a printhead 20 which sends current into the moderately resistive sheet 14'. Localized heating occurs as current passes from the printhead 20 through the moderately resistive sheet 14' to the conducting sheet 16'. Current from the conducting sheet 16' follows a path through collection plate 24' back to the printing electrode driver 26'.

Figure 3:
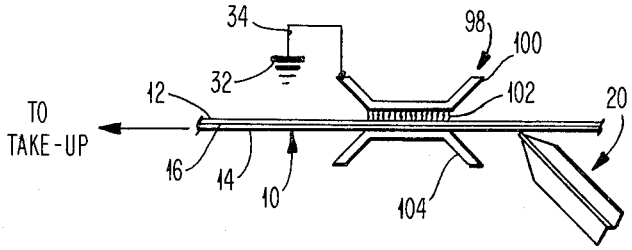
FIG. 3 is a plan view of a basic printing arrangement employing current collection according to the subject invention.

Referring to FIG. 3, the present invention involves a recognition that the conducting layer 16 of a resistive printing ribbon, such as the ribbon 10, while being completely covered by an ink layer 12 (see also FIG. 1) in its unused state may be accessed after the printing site defined by the printhead 20. To achieve electrical contact, advantage may be taken of voids resulting from ink transfers to a receiving medium (not shown in FIG. 3) which bare the conducting layer 16. Contacting means 98 such as a brush 100 having resilient electrically conducting bristles 102 enters voids in the ink layer 12 and is positioned on the ink side.

Printing current flow is indicated by arrows in FIG. 4 (a current direction is assumed for convenience of explanation). Current is introduced into the ribbon 10 by a printhead 20 that may, for example, include clamping blocks 200 between which an insulating pad 202 and a set of electrodes 204 are pressed. During printing, the electrodes 204 swipe across the ribbon 10 which is pressed against a receiving medium 206 that is supported by a platen 208. Current enters the ribbon through resistive layer 14 and tends to flow directly to the conducting layer 16 (greatly exaggerated in thickness). According to the invention, at least a portion of the current is collected for return by direct contact with the conductive layer 16 through the ink layer 12 side of the ribbon 10. The contacting means 98 is a roller 210 of an electrically conducting rubber that deforms under pressure from an opposing roller 212 to enter voids in the ink layer 12. Again, the contacting means 98 is located on the takeup side of the printhead 20 and on the side of ribbon 10 that is coated with the ink layer 12. A return path connection from roller 210 to the current source (not shown) is also provided as was mentioned above.

Referring to FIG. 5, the contacting means 98 is a roller 300 with surface projections 302 that penetrate the ink layer 12 in cooperation with pressure rollers 304. A return path for collected current is provided by a wiper 306 which is electrically connected to a common terminal 32 by a connection 34.

A typical environment for current collection according to the invention may include a path for ribbon 10 starting at a supply reel 400 and wrapping around a printhead 20 that is mounted to a carrier 402 (exaggerated in size). Movement of carrier 402 to provide relative printing motion is guided by a rail 404 and controlled by a leadscrew 406 as is known in the art.

The ribbon 10 is threaded past a current collection means 98 which is mounted on the carrier 402 and wraps around a guide roller 408. From the guide roller 408, the ribbon 10 is directed to the takeup reel 410. For this alternative, contacting means 98 is a pair of metal roller brushes 412 that are cylindrical in form such as the brushes known for cleaning rifles. Pressure to assure good contact is applied by an opposing pressure pad 414. It should be noted that guide means such as guide roller 408 serves to wrap the ribbon 10 around the printhead 20 to permit convenient access to the surface of ribbon 10 defined by the ink layer 12.

In operation, electrical printing currents are selectively supplied by printing electrode driver 26 via the signal channels 28 to the printhead 20. These currents enter the resistive layer 14 and tend to pass directly to the conducting layer 16. From the conducting layer 16, the currents are collected at least in part by contacting means 98. To assure a current path for startup when no bare areas of the conducting layer may be present, some conducting material such as carbon may be provided in ink layer 12 or an alternate path may be provided using the pressure means 414 and a separate connection 420 to common terminal 32. With the connection 420, the current divides between contacting means 98 and pressure means 414 providing an even lower inpedance return path. It is also possible to provide a section at the beginning of a ribbon 10 that does not have the ink layer 12 so that access may be had to the conducting layer for startup.

The invention has been described in detail with respect to preferred implementation thereof. However, it will be appreciated that variations and modifications are possible within the spirit and scope of the claimed invention. For example, various contacting means may be employed to penetrate the ink layer to contact the conducting layer of the ribbon and the direction of printing current flow from the printhead may be either toward or away from the ribbon.

What is claimed is:

1. A signal coupling arrangement for use in a printer of the kind that utilizes a ribbon having an outer layer that is moderately conducting, an outer ink transfer layer and an intermediate conducting layer, said printer further including a printhead arranged with a set of electrodes in contact with said moderately conducting layer, means for causing relative movement for swiping said printhead along said ribbon in a printing direction to define a takeup end of said ribbon relative to said printhead, and energizing means for selectively applying printing signals to said electrodes, said energizing means having a terminal to which said printing signals must be coupled to effect printing transfers of said ink layer, said signal coupling arrangement comprising electrical contacting means located on said takeup side of said printhead and adjacent said ink transfer layer of said ribbon, pressure means for holding said ribbon in intimate contact with said contacting means to establish an electrical contact with said conducting layer through said ink transfer layer, means for connecting said contacting means to said terminal whereby a printing signal path is established from said printhead through said ribbon to said terminal.

2. A signal coupling arrangement according to claim 1 wherein said contacting means includes means for piercing intact portions of said ink transfer layer to establish contact with said conducting layer.

3. A signal coupling arrangement according to claim 2 wherein said piercing means is a metal roller having projecting teeth for penetrating said ink transfer layer.

4. A signal coupling arrangement according to claim 1 wherein said contacting means is a roller of resilient conducting material that deforms under pressure to enter voids in said ink transfer layer resulting from printing to achieve contact with said conducting layer.

5. A signal coupling arrangement according to claim 1 wherein a ribbon guide, that is located to the takeup side of said contacting means, causes said ribbon to wrap around said printhead whereby access to said ink transfer layer by said contacting means is facilitated.

6. For use in an electro-thermal printing system of the kind having:

a ribbon that includes a moderately resistive layer defining one outer surface, a thermally transferrable ink layer defining the other outer surface, and an intermediate highly conducting layer, a printhead having at least one electrode, means defining a ribbon path extending to include a zone for engagement with said printhead, means for causing relative motion between said printhead and said ribbon to establish a ribbon advance direction, and driver means for selectively applying current signals to said electrode(s) for causing localized transfer of said ink transfer layer for printing, said driver means including a terminal for completing a current signal path, a printing current collection arrangement comprising:

an electrically conducting contact that is located on said ribbon path beyond said printing zone in the ribbon advance direction, said contact being adjacent the surface of said ribbon defined by said ink transfer layer, means for directing said ribbon into intimate engagement with said contact whereby said ink layer and said conducting layer, where the ink transfer layer has been removed, communicate electrically with said contact, and means for establishing an electrical current path between said contact and said terminal of said driver means whereby electrical printing currents may be selectively transmitted from said driver means to effect printing.

7. A printing current collecting arrangement according to claim 6 wherein said electrically conducting means is a resilient roller which enters voids produced by printing removal of said ink transfer layer to establish an electrical connection with said conducting layer.

8. A printing current collecting arrangement according to claim 6 wherein said electrically conducting contact includes rigid electrically conducting projections for penetrating said ink layer to engage said conducting layer.

9. A printing current collecting arrangement according to claim 6 wherein a ribbon guide means is located on the ribbon path to the ribbon advance side of said electrically conducting contact for wrapping said ribbon around said printhead whereby access to said ink layer is facilitated.

* * * * *